US006704626B1

(12) United States Patent
Herzog et al.

(10) Patent No.: US 6,704,626 B1
(45) Date of Patent: Mar. 9, 2004

(54) LOGISTICS SYSTEM AND METHOD WITH POSITION CONTROL

(75) Inventors: Stanley M. Herzog, St. Joseph, MO (US); Ronald A. Schmitz, Clarksdale, MO (US); Ivan E. Bounds, St. Joseph, MO (US); Randy L. Poggemiller, Easton, MO (US)

(73) Assignee: Herzog Contracting Corp., St. Joseph, MI (US)

( * ) Notice: Subject to any disclaimer, the term of this patent is extended or adjusted under 35 U.S.C. 154(b) by 528 days.

(21) Appl. No.: 09/285,290

(22) Filed: Apr. 2, 1999

(51) Int. Cl.[7] ..... G05D 1/00; G06F 17/00; G01C 21/00; B61L 1/02

(52) U.S. Cl. ..... 701/19; 701/207; 701/213; 701/214; 701/215; 246/127

(58) Field of Search ..... 701/207, 213, 701/214, 215, 19, 50; 246/127

(56) References Cited

U.S. PATENT DOCUMENTS

| | | | | |
|---|---|---|---|---|
| 3,971,454 A | | 7/1976 | Waterbury | |
| 4,781,119 A | | 11/1988 | Davis | |
| 4,835,537 A | | 5/1989 | Manion | |
| 5,129,605 A | | 7/1992 | Burns et al. | |
| 5,225,842 A | | 7/1993 | Brown et al. | |
| 5,259,337 A | | 11/1993 | Rasmussen | |
| 5,284,097 A | | 2/1994 | Peppin et al. | |
| 5,359,942 A | | 11/1994 | Ward | |
| 5,387,858 A | | 2/1995 | Bender et al. | |
| 5,390,125 A | * | 2/1995 | Sennott et al. | 701/214 |
| 5,574,469 A | | 11/1996 | Hsu | |
| 5,657,700 A | * | 8/1997 | Bounds | 105/311.1 |
| 5,684,385 A | | 11/1997 | Guyonneau et al. | |
| 5,703,468 A | | 12/1997 | Petrillo | |
| 5,714,948 A | | 2/1998 | Farmakis et al. | |
| 5,768,128 A | * | 6/1998 | Thompson et al. | 702/2 |
| 5,809,448 A | * | 9/1998 | Gimenez et al. | 246/1 R |
| 5,835,377 A | | 11/1998 | Bush | |
| 5,850,620 A | * | 12/1998 | Skotnikov et al. | 702/3 |
| 5,867,122 A | | 2/1999 | Zahm et al. | |
| 5,904,296 A | * | 5/1999 | Doherty et al. | 239/61 |
| 6,027,053 A | * | 2/2000 | Anderson et al. | 239/681 |
| 6,092,745 A | * | 7/2000 | Seymour et al. | 239/675 |
| 6,161,986 A | * | 12/2000 | Smith et al. | 404/75 |

* cited by examiner

*Primary Examiner*—William A. Cuchlinski, Jr.
*Assistant Examiner*—Brian Broadhead
(74) *Attorney, Agent, or Firm*—Shook, Hardy & Bacon L.L.P.

(57) ABSTRACT

A logistics system and method are mounted on a vehicle and utilize vehicle position control for logistics operations, such as loading and unloading material to and from the vehicle. The position control can be GPS-based and/or based on linear movement of the vehicle, such as movement of a railcar along a rail track. A computer-based position control subsystem mounted on the vehicle is connected to and operates vehicle-mounted components for performing the logistics functions.

2 Claims, 5 Drawing Sheets

LOGISTICS SYSTEM AND METHOD WITH POSITION CONTROL

BACKGROUND OF THE INVENTION

1. Field of the Invention

The present invention relates generally to the field of logistics, and more particularly to a GPS-based system for controlling logistics in connection with a vehicle.

2. Description of the Prior Art

The field of logistics management is relatively broad and includes a wide range of systems for tracking, controlling and reporting logistics operations involving various types of materials. For example, loading and unloading materials are important logistics operations in the transportation field.

Automation is a primary goal of many logistics management systems. The commercial availability of computer hardware and software for logistics applications has led to a relatively high degree of automation. For example, computerized systems are available for controlling material loading and unloading operations.

The global positioning system (GPS) is a significant recent development in the field of vehicle navigation. GPS-based navigation systems are in widespread use, particularly in commercial vehicles. Current, state-of-the-art, GPS-based navigation systems provide positioning information with a relatively high degree of accuracy. Global position coordinates accurate to within a few meters can be obtained with current, commercially-available equipment.

The present invention applies the precise positioning features of current GPS equipment to the logistics management field, and more particularly to material loading and unloading operations. Heretofore there has not been available a GPS-based logistics system and method with the advantages and features of the present invention.

SUMMARY OF THE INVENTION

In the practice of the present invention, a logistics system is provided for a vehicle, such as a railcar. The disclosed embodiment of the logistics system includes a position control subsystem mounted on board the vehicle, an hydraulic actuator subsystem, a ballast discharge mechanism, and the global positioning system (GPS). The position control subsystem includes a microprocessor which associates positioning data (e.g., GPS coordinates) for the vehicle with specific logistics operations, such as material loading and unloading. A control interface is provided for decoding signals from the microprocessor and for addressing them to respective components of the actuator subsystem for operating same. In the ballast railcar embodiment of the invention as shown, hopper doors are opened and closed to direct the flow of ballast therefrom onto a rail track. In the practice of the method of the present invention, the GPS is used for determining vehicle position. A logistics operation is performed at a predetermined location.

OBJECTS AND ADVANTAGES OF THE INVENTION

The principal objects and advantages of the present invention include: providing a logistics management system and method; providing such a system and method which utilize the global positioning system (GPS); providing such a system and method which are adaptable to various vehicles; providing such a system and method which are adapted for use in conjunction with material loading and unloading operations; providing such a system and method which are adapted for controlling material discharge from railcars; providing such a system and method which are adapted to utilize vehicle movement for positioning purposes; providing such a system and method which are adapted for use with various positioning systems; providing such a system and method which utilize commercially available GPS equipment; providing such a system and method which utilize a computer mounted on board a vehicle for logistics management; providing such a system and method which can reduce the labor required for logistics operations; providing such a system and method which can be retrofitted existing vehicles; providing such a system and method which can be installed on new vehicles; providing such a system and method which are adaptable for use with various discharge control means in connection with unloading operations; providing such a system and method which include data storage means and steps for storing data for use in conjunction with logistics operations; and providing such a system and method which are economical and efficient.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
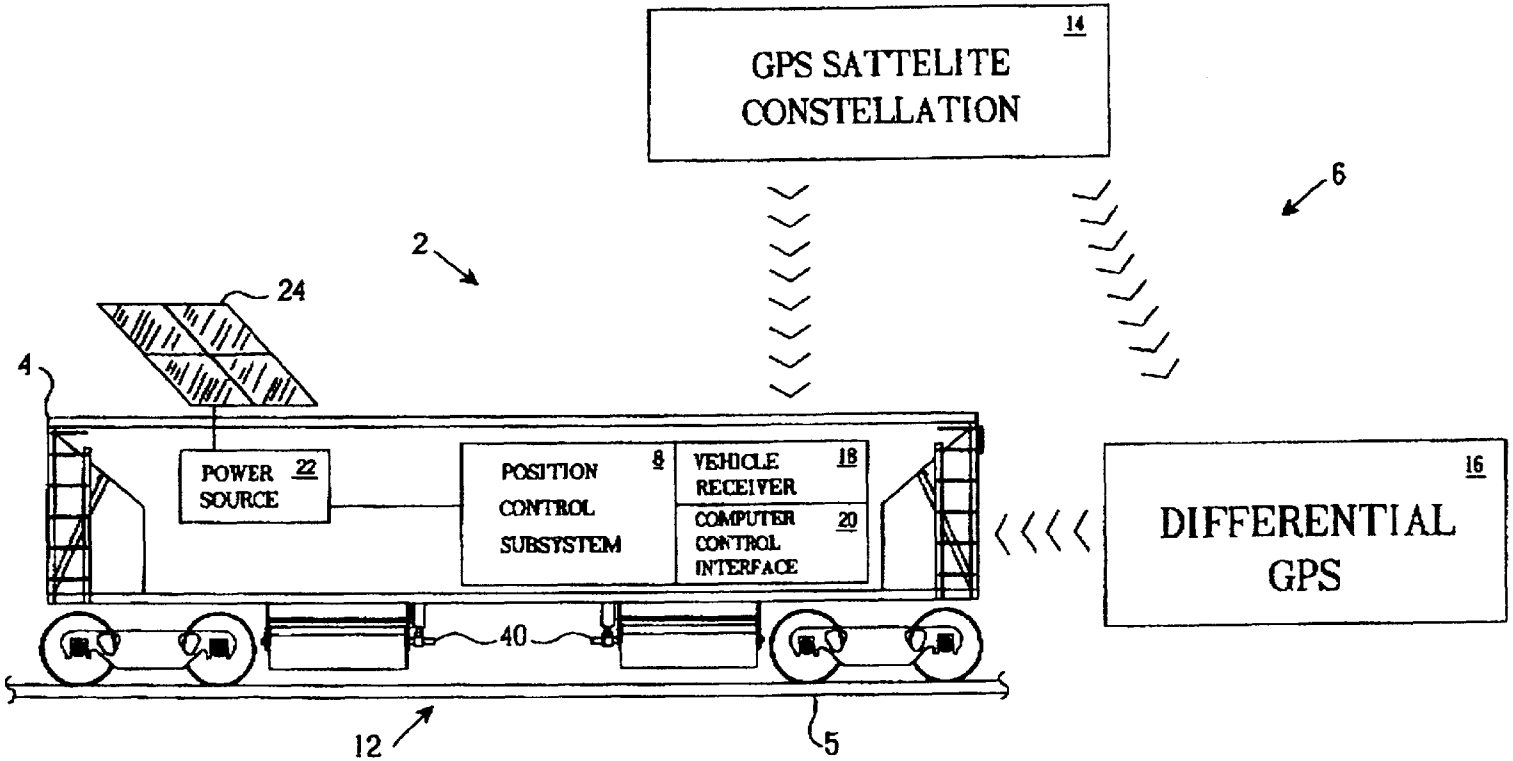
FIG. 1 is a schematic view of a logistics system with GPS positioning control embodying the present invention, shown installed on a railcar for controlling the loading and unloading operations of same.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 2 generally designates a logistics system embodying the present invention. Without limitation on the generality of useful applications of a logistics system 2, it is shown installed on a railcar 4 for controlling unloading operations thereof.

The logistics system 2 generally comprises the global positioning system (GPS) 6, an on-board position control subsystem 8, an hydraulic actuator subsystem 10 and a ballast discharge mechanism 12.

II. GPS 6

The GPS 6 (FIG. 1) includes a satellite constellation 14 comprising a number of individual satellites whose positions are continuously monitored. The satellites transmit signals, including positioning data, which can be received by differential GPS stations 16 located in fixed positions and by GPS receivers, such as the on-board vehicle receiver 18, which are typically mobile. Various other configurations and arrangements of the GPS can be employed with the present invention. The differential GPS station 16 receives signals from the satellite constellation 14 and transmits signals to mobile GPS receivers.

III. On-Board Position Control Subsystem 8

Figure 2:
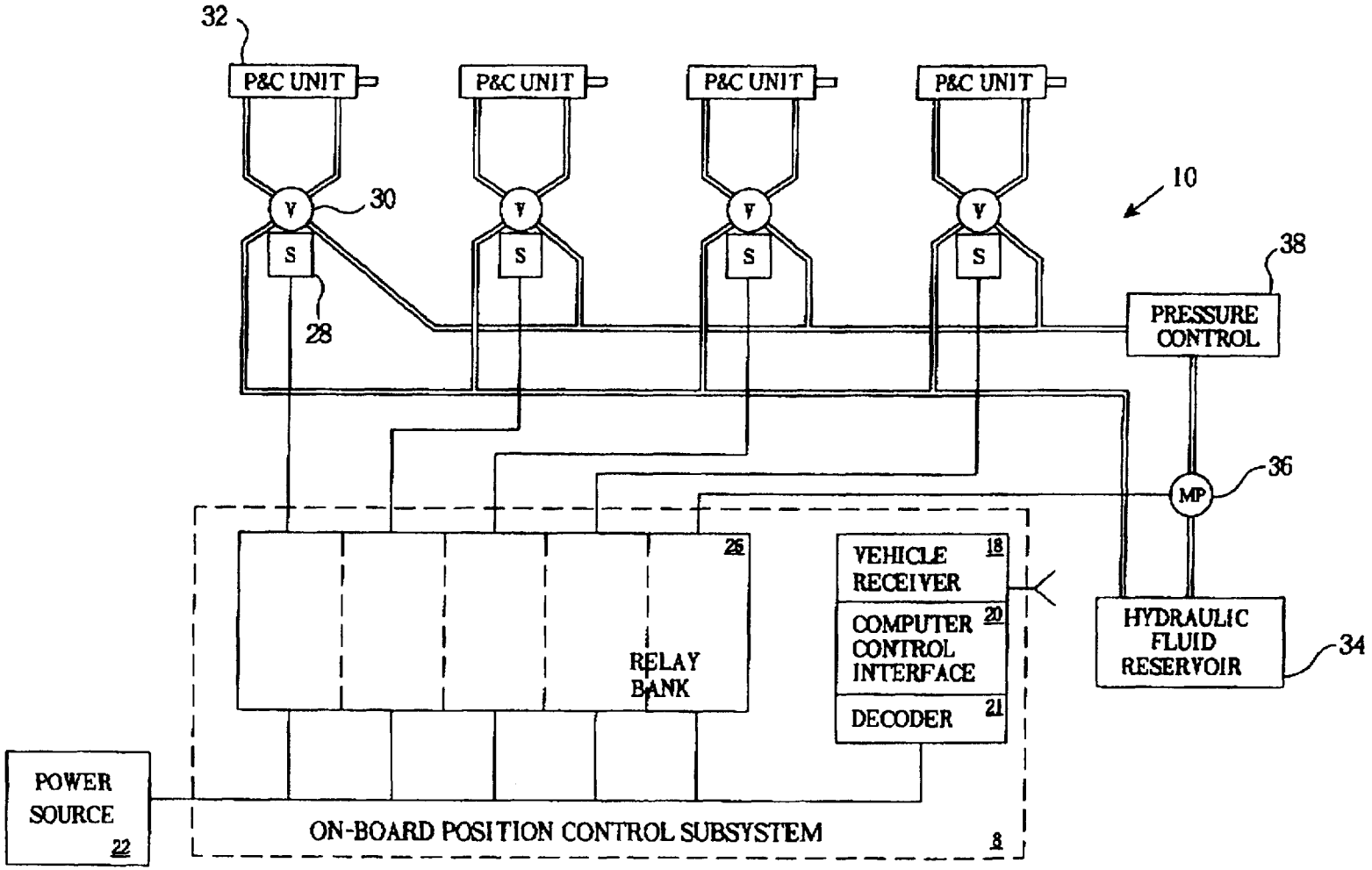
FIG. 2 is a schematic diagram of an hydraulic actuating system for hopper door assemblies on the railcar and a position control subsystem.
Figure 3:
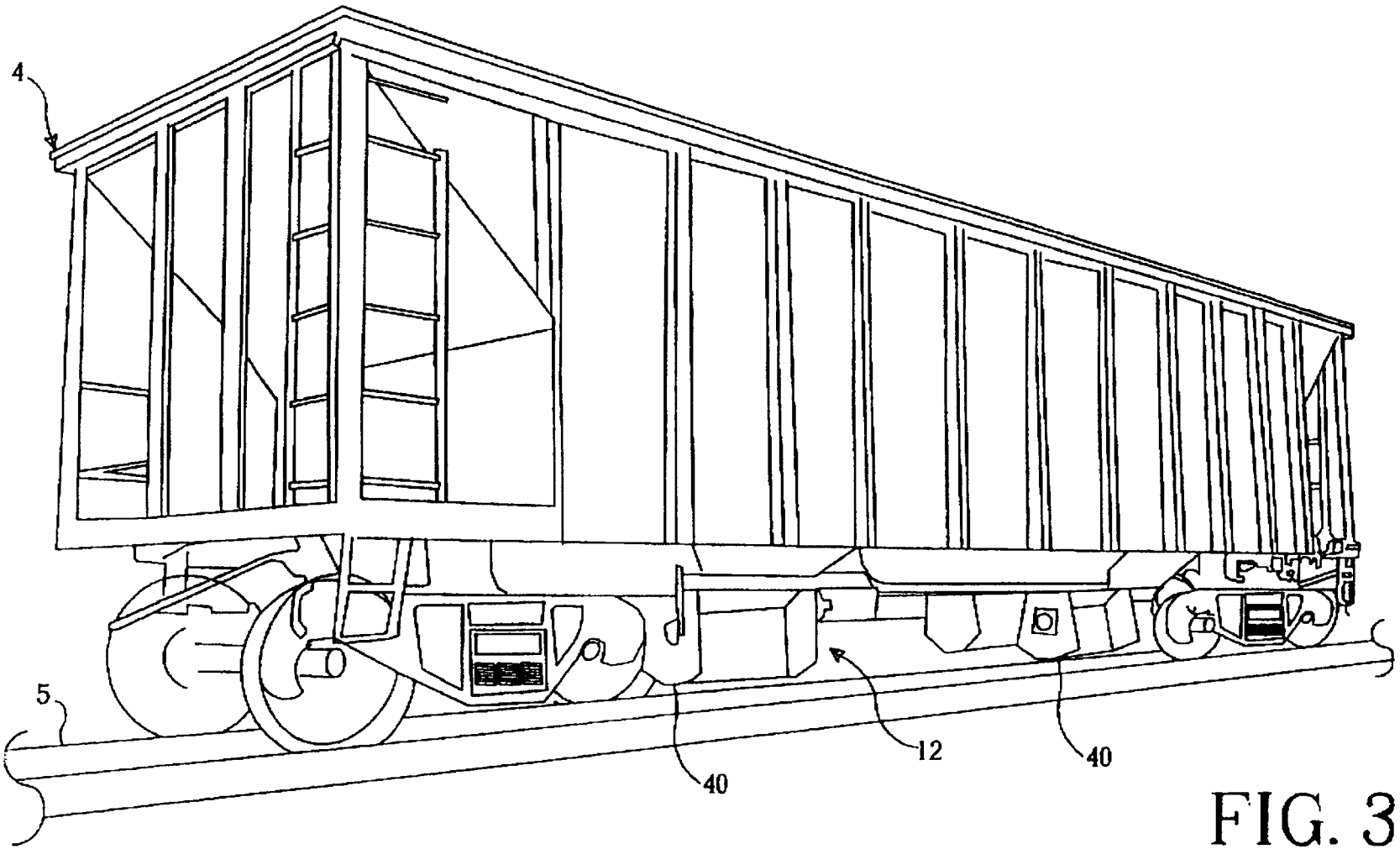
FIG. 3 is a perspective view of a railcar with a ballast discharge mechanism controlled by the logistics system and method.

The on-board position control subsystem 8 (FIG. 2) is mounted on the railcar and includes the GPS vehicle receiver 18, which receives position data signals (e.g., GPS coordinates) from both the satellite constellation 14 and the differential GPS 16. The vehicle receiver 18 can comprise any of a number of suitable, commercially-available, mobile receiver units. The vehicle receiver 18 is connected to a microprocessor-based control interface/computer 20 which receives positioning data signals from the vehicle receiver 18, processes same and interfaces with the actuator subsystem 10. The control interface 20 can include any suitable microprocessor and preferably can be programmed to store data relating to logistics operations in response to GPS signals.

The control interface 20 includes a decoder 21 with inputs connected to the microprocessor for receiving command signals addressed to specific piston-and-cylinder units 32 in the actuator subsystem 10. The output of the decoder 21 is input to a relay bank 26 with multiple relays corresponding to and connected to respective components of the hydraulic actuator subsystem 10. The position control subsystem 8 is connected to a suitable, on-board electrical power source 22, which can utilize a solar photovoltaic collector panel 24 for charging or supplementing same.

IV. Hydraulic Actuator Subsystem

The hydraulic actuator subsystem 10 (FIG. 2) includes multiple solenoids 28 each connected to and actuated by a respective relay of the relay bank 26. Each solenoid 28 operates a respective hydraulic valve 30. The valves 30 are shifted between extend and retract positions by the solenoids 28 whereby pressurized hydraulic fluid is directed to piston-and-cylinder units 32 for respectively extending and retracting same. The piston and cylinder units 32 can comprise two-way hydraulic units, pneumatic units or any other suitable actuators. An hydraulic fluid reservoir 34 is connected to the valves 30 through a suitable motorized pump 36 and a pressure control 38.

V. Ballast Discharge Mechanism 12

Figure 4:
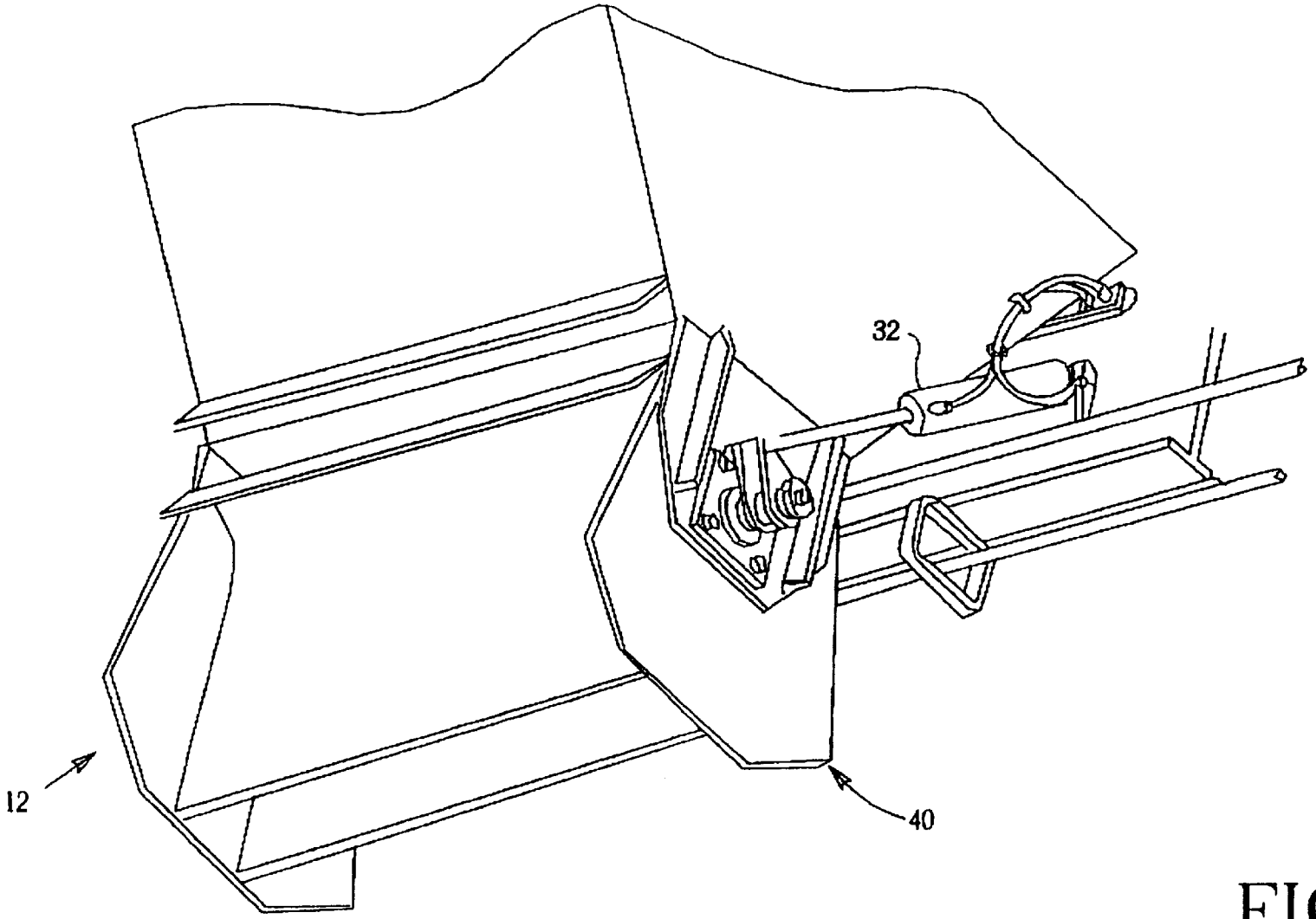
FIG. 4 is an enlarged, fragmentary, lower perspective view of the ballast discharge mechanism, particularly showing a hopper door assembly thereof.
Figure 5:
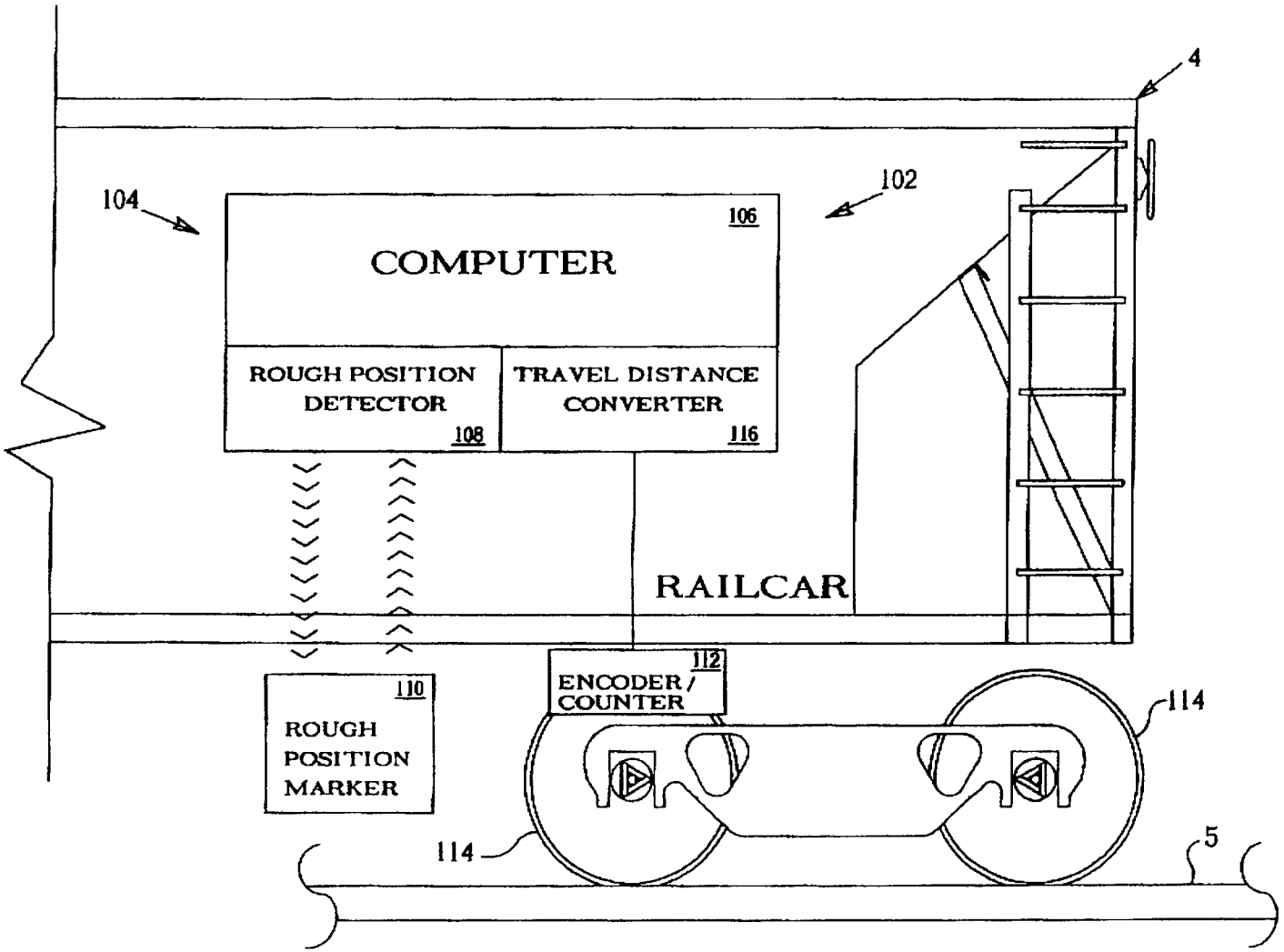
FIG. 5 is a schematic diagram of a logistics system comprising a first modified embodiment of the present invention with an alternative positioning control subsystem.

The ballast discharge mechanism 12 includes four hopper door assemblies 40 installed on the underside of the railcar 4 and arranged two to each side. The hopper door assemblies 40 discharge the railcar contents laterally and are adapted to direct the discharge inwardly (i.e. towards the center of a rail track 5) or outwardly (i.e. towards the outer edges of the rail track 5). The construction and function of the hopper door assemblies 40 are disclosed in the Bounds U.S. Pat. No. 5,657,700, which is incorporated herein by reference. As shown in FIG. 4, each hopper door assembly is operated by a respective piston-and-cylinder unit 32 for selectively directing the flow of ballast therefrom.

VI. Method of Operation

In the practice of the method of the present invention, the on-board position control subsystem 8 is preprogrammed with various data corresponding to the operation of the logistic system 2. For example, discharge operations of the ballast discharge mechanism 12 can be programmed to occur at particular locations. Thus, ballast can be applied to a particular section of rail track 5 by inputting its GPS coordinates and programming the position control subsystem 8 to open the hopper door assemblies 40 in the desired directions and for predetermined durations. The GPS signals received by the on-board position control subsystem 8 can provide relatively precise information concerning the position of the railcar 4.

VII. First Modified Embodiment Logistics System and Method 102

The reference numeral 102 generally designates a logistics system 102 comprising a first modified embodiment of the present invention with a linear movement-based position control subsystem 104. The position control subsystem 104 can comprise any suitable means for measuring the travel of a vehicle, such as the railcar 4, and/or detecting its position along the rail track 5 or some other travel path.

The position control system 104 includes a computer 106 which interfaces with an optional rough position detector 108 for detecting rough position markers 110. For example, the rough position markers 110 can be located alongside the rail track 5 whereby the rough position detector 108 provides a signal to the computer 106 when the railcar 4 is positioned in proximity to a respective rough position marker 110. The position control subsystem 104 can also include a suitable linear distance measuring device for measuring travel. For example, an encoder/counter 112 can be mounted on the railcar 4 for measuring distances traveled by same or for counting revolutions of a railcar wheel 114. The encoder/counter 112 can be connected to a travel distance converter 116 which provides signals corresponding to travel distances to the computer 106. The computer 106 can interface with an hydraulic actuator subsystem 10 such as that described above.

It is to be understood that while certain forms of the present invention have been illustrated and described herein, it is not to be limited to the specific forms or arrangement of parts described and shown.

What is claimed and desired to be secured by Letters Patent is as follows:

1. A logistics system to control application of ballast along a selected section of railroad and comprising:

a) a railroad car including a ballast hopper and a pair of hopper doors engaged with said hopper and operable to open and close to thereby control discharge of ballast from said hopper;

b) a pair of hydraulic door actuators engaged respectively with said hopper doors and controllable to open and close said hopper doors;

c) a global positioning system (GPS) receiver engaged with said car and operative to generate a location signal representing a location of said car, said GPS reciever being adapted to receive GPS coordinate signals from both a GPS satellite constellation and from a differential GPS;

d) said railroad car including a wheel and travel distance measuring means including a wheel encoder with said wheel for counting revolutions and partial revolutions thereof, a travel distance converter receiving input from said encoder, and a travel distance computer connected to and adapted for receiving input from said travel distance converter;

e) a position control subsystem coupled to said GPS receiver, said encoder, and said hopper door actuators, said position control subsystem storing data representing a location of said selected section of said railroad along which application of ballast is desired; and f) said GPS receiver communicating information relating to the railroad car position to the position control system, said travel distance computer interfacing with said position control system whereby GPS position information and linear-movement travel distance information therefrom respectively are utilized to cause said position control subsystem to activate said hopper door actuators to open said hopper doors at the beginning of said selected section of said railroad and to retain same along said selected section with said railroad car in motion and only for such a duration in which said GPS receiver detects a location of said car corresponding to said selected section of said railroad.

2. A logistics system to control application of ballast along a selected section of railroad and comprising:

a railroad car including a ballast hopper and a pair of hopper doors engaged with said hopper and operable to open and close to thereby control discharge of ballast from said hopper;

b) a pair of hydraulic hopper door actuators engaged respectively with said hopper doors and controllable to open and close said hopper doors;

c) a global positioning system (GPS) receiver engaged with said car and operative to generate a location signal representing a location of said car, said GPS receiver being adapted to receive GPS coordinate signals from both a GPS satellite constellation and from a differential GPS;

d) said railroad car including a wheel and travel distance measuring means including a wheel encoder engaged with said wheel for counting revolutions and partial revolutions thereof, a travel distance converter receiving input from said encoder, a rough position marker fixedly mounted at a predetermined location along the railroad, a rough position detector mounted on the railroad car and adapted for generating a signal in response to proximity of said railroad car to said rough position marker, and a travel distance computer connected to and adapted for receiving input from said travel distance converter and said rough position detector;

e) a position control subsystem coupled to said GPS receiver, said encoder, and said hopper door actuators, said position control subsystem storing data representing a location of said selected section of said railroad along which application of ballast is desired; and f) said GPS receiver receiving input from said GPS satellite constellation and from said differential GPS, said GPS receiver communicating information relating to the railroad car position to the position control system, said travel distance computer interfacing with said position control system whereby GPS position information and linear-movement travel distance information thereform respectively are utilized to cause said position control subsystem to activate said hopper door actuators to open said hopper doors at the beginning of said selected section of said railroad and to retain same along said selected section with said railroad car in motion and only for such a duration in which said OPS receiver detects a location of said car corresponding to said selected section of said railroad.

* * * * *